United States Patent [19]

Nourse et al.

[11] Patent Number: 4,531,117

[45] Date of Patent: Jul. 23, 1985

[54] VARIABLE FREQUENCY RF ELECTRONIC SURVEILLANCE SYSTEM

[75] Inventors: Gary E. Nourse, Osceola, Wis.; Dean M. Dowdle, White Bear Lake, Minn.

[73] Assignee: Minnesota Mining and Manufacturing Company, St. Paul, Minn.

[21] Appl. No.: 510,954

[22] Filed: Jul. 5, 1983

[51] Int. Cl.[3] ..... G08B 13/24

[52] U.S. Cl. ..... 340/572; 343/6.8 LC

[58] Field of Search ..... 340/572; 343/6.8 LC, 343/6.8 R

[56] References Cited

U.S. PATENT DOCUMENTS

| | | | |
|---|---|---|---|
| 3,740,742 | 6/1973 | Thompson et al. | 340/572 |
| 3,810,172 | 5/1974 | Burpee et al. | 343/5 PD |
| 4,023,167 | 5/1977 | Wahlstrom | 343/6.5 SS |
| 4,215,342 | 7/1980 | Horowitz | 343/6.8 LC |
| 4,251,808 | 2/1981 | Lichtblau | 340/572 |
| 4,321,586 | 3/1982 | Cooper et al. | 340/572 |
| 4,476,459 | 10/1984 | Cooper et al. | 340/572 |

*Primary Examiner*—Glen R. Swann, III

*Attorney, Agent, or Firm*—Donald M. Sell; James A. Smith; William B. Barte

[57] ABSTRACT

An electronic article surveillance system is disclosed, having a transmitter means for producing in an interrogation zone sequences containing a plurality of discrete different radio frequencies thereby causing a circuit present within the zone to resonate at its resonant frequency in response to energy absorbed at at least three different frequencies. A receiver means is provided to cause an alarm in the event of detection of three such resonances over two successive sequences.

44 Claims, 12 Drawing Figures least as wide as the sum of $\Delta f + BW_{max}$, where $BW_{max}$ is the broadest bandwidth of any of the LC circuits. Furthermore, to cause each such circuit to resonate, the transmitter preferably creates bursts at frequencies which are incrementally different from the next closest frequency by not more than one-third the narrowest bandwidth ($BW_{min}$) of any of the LC circuits. Such bursts are further desirably spaced at increments and include as many discrete frequencies as are determined by the expression $$\frac{3(Q_{max} \times \Delta f + f_{min})}{f_{min}},$$

where $Q_{max}$ is the highest Q-factor and $f_{min}$ is the minimum resonant frequency of any of the LC circuits. Thus, for example, where $Q_{max}$ is 100 and $\Delta f$ is 0.9 MHz, extending between $f_{min}$=4.05 MHz to a $f_{max}$ of 4.95, i.e., at ±10% tolerance in resonant frequency at a nominal resonant frequency of 4.5 MHz, the number of steps will be at least $$\frac{3(100 \times .9 + 4.05)}{4.05} = \frac{3(94.05)}{4.05} = 69.7.$$

In another preferred embodiment, the receiver of the present system is provided with additional features to enhance accurate detection of the LC circuits. Thus, the receiver desirably responds to received signals extending over only a limited frequency range and is tuned to maintain its limited frequency response centered on the transmitted frequency.

Additionally, the receiver preferably includes means activated during a first interval of time relatively early in each of the quiescent periods for comparing received signals believed to be produced by resonating circuits with signals representative of background noise in order to enhance signal discrimination. Such means are initially activated during a first interval of time relatively early in each of the quiescent periods when a signal produced by a resonating marker circuit would likely be present for providing a marker signal in response to electromagnetic signals received during that interval. Means are subsequently activated during a second interval of time occurring relatively later in each of the quiescent periods when no signals produced by resonating marker circuits would likely be present, for providing a noise signal in response to signals received during the second interval. In the event the marker signal exceeds the noise signal by a predetermined amount, a detector signal is then provided.

Desirably, the transmitter provides a number of bursts at each discrete frequency, with a quiescent period between each burst and repeats the repetitive bursts at all of the different discrete frequencies in consecutive sequences. Accordingly, the receiver then also desirably accumulates marker and noise signals provided following each burst at a single frequency to create a detector signal corresponding to that frequency if the accumulated marker signals at that frequency exceed the corresponding accumulated noise signals. Such accumulation is preferably repeated for the received marker and noise signals corresponding to each discrete frequency to create detector signals corresponding to all frequencies, which signals may, for example, result from an analog comparator which provides a high state only when the accumulated amplitude of the marker signals received following bursts at a single frequency exceed the accumulated amplitude of the corresponding noise signals.

The detector signals are in turn desirably stored, such as in a shift register, to enable comparison of those signals received during one sequence with those produced in a subsequent sequence. The comparison is preferably performed to determine the presence of detector signals corresponding to three adjacent frequencies in two consecutive sequences, and in that event, a prealarm signal is produced. Finally, the prealarm signal is preferably inhibited from producing an alarm signal if detector signals are detected which correspond to more than a limited number of discrete frequencies, such as a selected number of adjacent frequencies within the bandwidths of one, or at most, a few marker circuits such as could be within an interrogation zone at a given time. Such an inhibition circuit thus prevents the presence of a low Q circuit having an appropriate resonant frequency from falsely resulting in an alarm signal.

DETAILED DESCRIPTION

Figure 1:
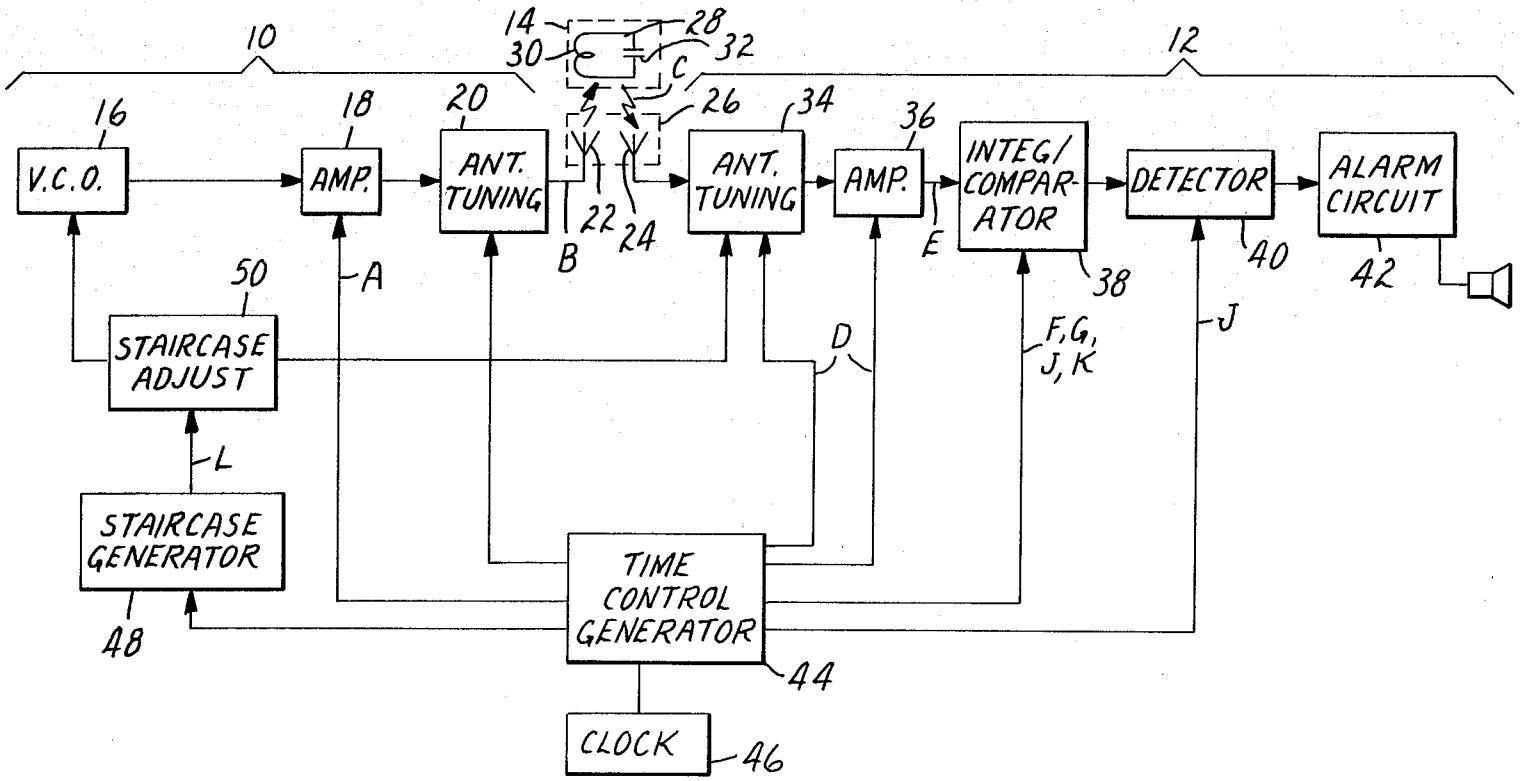
FIG. 1 is a block diagram showing the system of the present invention.

As shown in FIG. 1, the system of the present invention preferably includes a transmitter section 10, a receiver section 12, and at least one marker 14. The transmitter portion 10 includes a voltage controlled oscillator 16 which produces repetitive sequences of oscillations at each of the discrete frequencies provided in the present system. These sequences are applied to an amplifier stage 18 which both amplifies and switches each of the discrete frequencies to provide bursts with a quiescent period between each burst. The output of the amplifier 18 is coupled to an antenna tuning stage 20 which is used to tune the transmit antenna 22.

VARIABLE FREQUENCY RF ELECTRONIC SURVEILLANCE SYSTEM

FIELD OF THE INVENTION

This invention relates to radio frequency (RF) electronic article surveillance systems in which markers having circuits resonant at a desired frequency are used. In particular, the present invention relates to such systems in which pulses of RF energy are transmitted into an interrogation zone and energy absorbed by the marker circuit is transmitted at its resonant frequency and is detected during quiescent intervals between the transmitted pulses.

BACKGROUND OF THE INVENTION

A variety of systems for detecting such a resonant circuit have previously been disclosed and utilized commercially with varying degrees of success. For example, a pulsed system such as described above is disclosed by Thompson (U.S. Pat. No. 3,740,742). The primary advantage of such a system is that it is much easier to detect the relatively weak signals generated by the marker circuit in the absence of much stronger fields produced by the transmitter. Other techniques for detecting the weaker marker signals over the much more intense transmitted signals include the detection of signals at frequencies other than that originally transmitted, such as by use of a marker which generates harmonics of the transmitted frequency. Similarly, it is known to sweep the transmitted energy over a range of frequencies encompassing the resonant frequency of the marker circuit such that the marker may be detected by conventional grid-dip techniques. As depicted by Burpee et al. (U.S. Pat. No. 3,810,172), it is also known to transmit a plurality of discrete frequencies, such as five, to allow for variation in the actual resonant frequency of targets or for change of resonance which might occur due to the presence of metallic bodies or other loading. In an extension of such a multi-frequency technique, Wahlstrom (U.S. Pat. No. 4,023,167) depicts a system in which each tag carries a number of circuits, each resonant at a different frequency, thus enabling each tag to be individually identified. That disclosure further suggests that the receiver may be tuned along with the transmitter and that a background signal may be detected when no tag signal is present, stored, and substracted from tag signals.

SUMMARY OF THE INVENTION

In the techniques described above, emphasis has been placed on the use of sweep frequencies or of a plurality of discrete frequencies to enable detection of sophisticated tags carrying a plurality of circuits resonant at different frequencies. Such complex tags have application in certain uses, such as baggage handling, but necessarily presuppose a more expensive tag. Similarly, even where only a single resonant circuit is used on each marker, as in Burpee et al., the prior art systems presuppose a non-disposable relatively expensive tag, the resonant frequency of which is well controlled and known and provide only a narrow range of differing transmitted frequencies to compensate for slight shifts in resonance due to loading of the circuits.

In contrast thereto, the system of the present invention is predicated on the assumption that the marker is to be disposable, and hence is very inexpensive. Such low cost further virtually dictates that manufacturing tolerances on the marker circuit be loose and precludes anything close to 100% testing of the circuits to enable sorting the circuits according to discrete resonant frequencies. Notwithstanding the above, such loose tolerance marker circuits are desirably used in antipilferage applications where the concern of merchants over possible false alarms, and customer ill-will are paramount.

Like prior art systems, the electronic article surveillance system of the present invention thus includes a means for transmitting spaced-apart bursts of RF energy, a means for receiving energy at the transmitted frequencies and a marker means which absorbs transmitted energy and reemits energy at its resonant frequency. In particular, the transmitter means creates within an interrogation zone bursts of electromagnetic energy at discretely different radio frequencies (RF) within a predetermined range of frequencies, each burst being spatially separated from the next by a quiescent period during which the transmitter does not transmit, and the receiver means receives electromagnetic signals at the radio frequencies during the quiescent periods and activates an alarm when the received signals exceed a predetermined level. The markers, adapted to be affixed to articles to be monitored within the interrogation zone each comprise an inductive-capacitive (LC) circuit resonant at a frequency within the range of transmitted frequencies such that when the marker is in the interrogation zone, RF transmitted energy is absorbed by the LC circuit and is reemitted at its resonant frequency during the subsequent quiescent period for receipt by the receiver.

A plurality of markers are provided in the present invention, each being adapted to be affixed to an article and each comprising an LC circuit including an inductive-capacitive-resistive combination designed to have a Q-factor of not less than 50, a nominal resonant frequency (f) and an associated bandwidth (BW) centered about the resonant frequency, all as defined by the expression $Q=f/BW$.

To reliably and unambiguously detect all such markers, regardless of their specific resonant frequencies, the transmitter of the present invention comprises means for creating within the interrogation zone bursts of a sufficient number of different frequencies that there are bursts of at least three different frequencies all three of which are sufficiently close to the resonant frequency of each of said LC circuits so as to fall within the bandwidth thereof. Analogously, the receiver comprises means at least responsive to frequencies extending through the bandwidth (BW) of all of the LC circuits for activating an alarm signal when signals exceeding a predetermined level and corresponding to at least three frequencies are detected, i.e. when a LC circuit is activated by at least three frequencies.

In a preferred, practical embodiment, the marker circuits are designed to have a Q-factor in the range of 70–100. Analogously preferred marker circuits desirably have a bandwidth (BW) in the range of 20–100 KHz, such that at a Q-factor of at least 50, the nominal resonant frequency must be greater than a range of frequencies between 1–5 MHz.

Similarly, the marker circuits are designed to resonate at a specific frequency within a predetermined frequncy range ($\Delta f$) of the nominal resonant frequency, such as for example within $\pm 10\%$. The transmitter thus also includes means for generating bursts of a plurality of different RF frequencies extending over a range at The transmit antenna 22 as well as a receive antenna 24 are positioned within a single enclosure 26, desirably located on one side of an interrogation zone. RF energy provided within the zone by the transmit antenna 22 is radiated so as to energize a marker 14 when present within the zone. The marker includes at least one tuned resonant circuit 28, including an inductor 30 and a capacitor 32. Energy transmitted via the transmitting antenna 22 having a frequency within the bandwidth of the resonant circuit 28 will be absorbed by that circuit and reradiated during the quiescent period between each transmitted burst. The reradiated energy will be received by the receive antenna 24 and further processed within the receiver 12.

The receiver of FIG. 1 may further be seen to include an antenna tuning stage 34, an amplifier 36, an integator/comparator 38, a detector 40, and an alarm circuit 42. Signals provided via the receive antenna 24 are coupled into the antenna tuning network 34, which has a narrow bandwidth, and is tracked to pass the same frequency as that being transmitted via the transmitter 10. Such frequencies are then coupled to the amplifier 36 and the output thereof processed so as to distinguish signals produced by a resonant circuit 28 within the interrogation zone from background noise. Appropriately processed detector signals are coupled to the detector 40 where additional processing is provided to provide an unambiguous alarm signal which is coupled to the alarm circuit 42.

Also shown in FIG. 1 as being common to both the transmitter and receiver are a time control generator 44 which is driven by a crystal controlled clock 46, a staircase generator 48 and a staircase adjust circuit 50. The time control generator provides appropriately timed control pulses to the respective portions of the transmitter and receiver, while the staircase generator generates appropriate voltage ramps utilized in providing the plurality of discrete frequencies in the voltage controlled oscillator 16 as well as in controlling the antenna tuning within the receiver.

Figure 2:
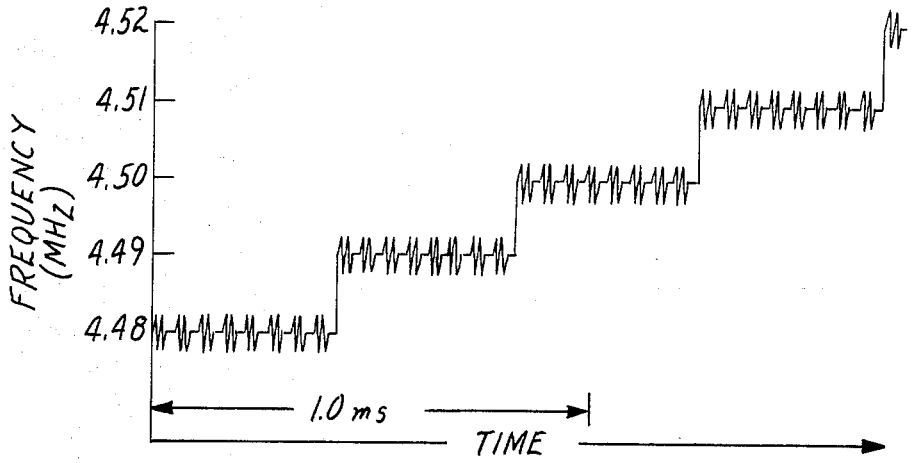
FIG. 2 is a pictorial view of the transmitted burst frequency applied to the interrogation zone by the transmitted of the present system.

The pictorial view of a preferred sequence of frequencies such as is transmitted via the transmit antenna into the interrogation zone is shown in FIG. 2. As may be there be seen, each frequency is transmitted as repetitive bursts, each burst being separated by a quiescent period. For example, in a preferred embodiment wherein the transmit frequency is centered about 4.5 MHz, incremental frequencies may be provided at approximately 4.48, 4.49, 4.50, 4.51, and 4.52 MHz. Furthermore, the transmitted energy at each of the frequencies includes eight bursts, each burst extending approximately 20 microseconds, followed by a 28 microsecond quiescent period. The succession of eight such bursts thus extends approximately 384 microseconds. In order that a sufficient number of discrete frequencies be provided to interrogate the plurality of markers having a range of resonant frequencies, it is further desirable that the transmitted frequencies extend over a predetermined range. Thus, for example, in a preferred embodiment it is desired that the range extend over $\pm 10\%$ of the center transmitted frequency of 4.5 MHz. Such a range may extend from 4.05 to 4.95 MHz. Alternatively, in a further preferred embodiment the predetermined range of frequencies may be somewhat less, for example, extending between 4.2 through 4.8 MHz, and include 64 discrete incremental frequencies, there being a 9.4 kHz separation between each adjacent frequency. Such a range of frequencies and duration of each transmitted burst thus complies with FCC limits on transmitted sweep rates, while enabling reliable detection of a resonant circuit.

Figure 3:
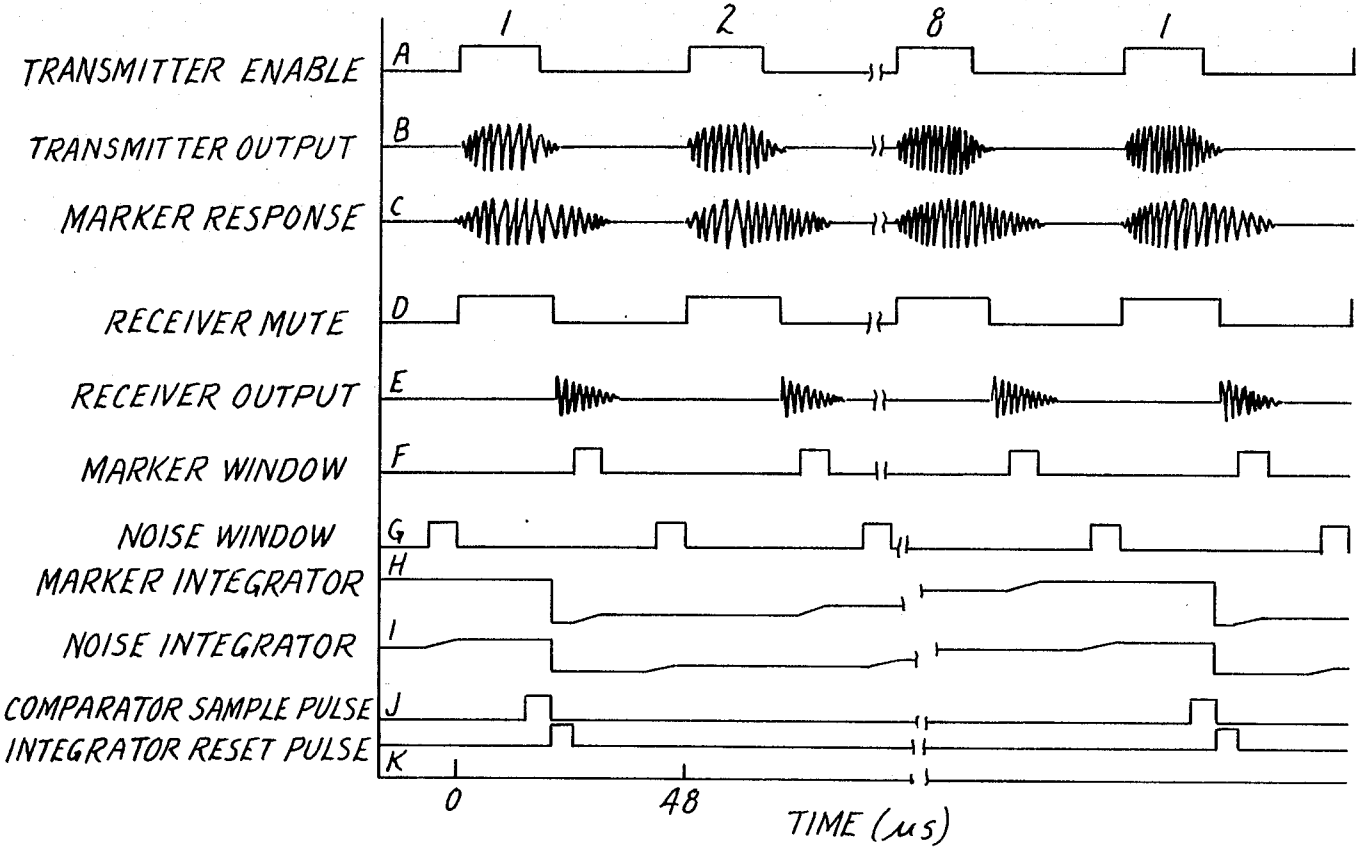
FIG. 3 is a timing diagram illustrative of the relationship of various signals utilized throughout the system of FIG. 1.

The control pulses provided by the time control generator 44 are shown in detail in the timing diagram of FIG. 3. As there shown, transmit enable pulses (curve A) are applied to the amplifier 18 so as to switch each frequency as provided by the voltage controlled oscillator 16 into a series of eight bursts, bursts 1, 2 and 8 of which are shown. Each high state of the transmit enable signal (curve A) is 20 microseconds in duration, while the low state or quiescent period following each high state is 28 microseconds in duration. The transmit enable pulses (curve A) thus result in transmitted energy being provided via the transmit antenna 22 in the form of radiated bursts as shown in Curve B. The oscillations are shown to gradually build up during each transmit enable period and upon cessation of that period to exponentially decrease in intensity, and during most of the quiescent period no energy is being transmitted. Transmitted energy at or near the resonant frequency of a resonant circuit 28 will thus cause energy to be absorbed by the circuit as shown in Curve C. The absorbed energy is reemitted, such emission persisting after cessation of the transmitted pulses, and extending during an appreciable portion of each quiescent period. Curve D represents receiver mute pulses which are applied to the antenna tuning and amplifier portions 34 and 36 respectively of the receiver 12 shown in FIG. 1. When the mute pulses are in a high state the antenna tuning and amplifier stages are deactivated and thus prevent energy produced during the transmit cycle from being received. In contrast, when the mute pulses are in a low state, the antenna tuning and amplifier stages are activated, thus enabling the decaying energy provided in the marker responses to be detected. The receiver mute pulses (Curve D) are slightly longer in duration than the transmit enable pulses A, thereby ensuring that the receiver sections are not activated until all of the transmitted energy has decayed as shown in Curve B. The output of the amplifier 36 (Curve E) essentially comprises signals corresponding to the portion of the marker response signals C remaining after the receiver mute pulses (Curve D) are in a low state.

In a preferred embodiment, as discussed in more detail hereinafter, the integrator/comparator network 38 separates each quiescent period into two portions, a first portion occurring relatively early during each quiescent period and which corresponds to the time during which signals provided by a resonant circuit would be expected to be present, and a second portion, occurring late during each quiescent period during which no marker signal would be expected to be present and which would represent background noise. Each of these two portions are enabled by appropriate pulses, shown in FIG. 3 as a marker window pulse (Curve F) and noise window pulse (Curve G). It will thus be seen in FIG. 3 that the marker window pulses (Curve F) occur while the receiver pulses still have appreciable amplitude. In contrast, the noise window pulses (Curve G) occur at a time when the receiver pulses have decayed to zero amplitude. The integrator/comparator network 38 includes a pair of integrators, one being activated by the marker window pulses to integrate marker signals received during a predetermined number of successive quiescent periods, and the second being activated by the noise integrator pulses to integrate the background noise signals received during the same successive quiescent periods. The successive periods are desirably those corresponding to each individual frequency, such as namely the eight successive bursts, discussed above, three of which are shown in FIG. 3. Accordingly, at the cessation of the eight bursts at a given frequency, and after the electronics have restablized, an integrator reset pulse (Curve K) is provided to reset both the integrators and reestablish a zero integration level as shown in Curves H and I. Accordingly, during each eight successive quiescent periods, and during each of the respective marker and time windows, the marker integrator and noise integrator will accumulate signal levels as shown in Curves H and I respectively. Upon completion of the eighth quiescent period, at a time dictated by the comparator sample pulse (Curve J) the relative levels in each of the integrators are compared within the comparator portion of the network 38 and an appropriate output signal produced.

The generation of the respective timing signals shown in FIG. 3 within the time control generator 44 of FIG. 1 are accomplished by circuits well known to those skilled in the art. For example, the clock 46 of FIG. 1 is a crystal controlled oscillator having a base frequency of 1 MHz. These clock pulses are acted upon within the time control generator 44 by appropriate shift registers, counters and the like to provide the respective pulses as shown in FIG. 3.

Figure 4:
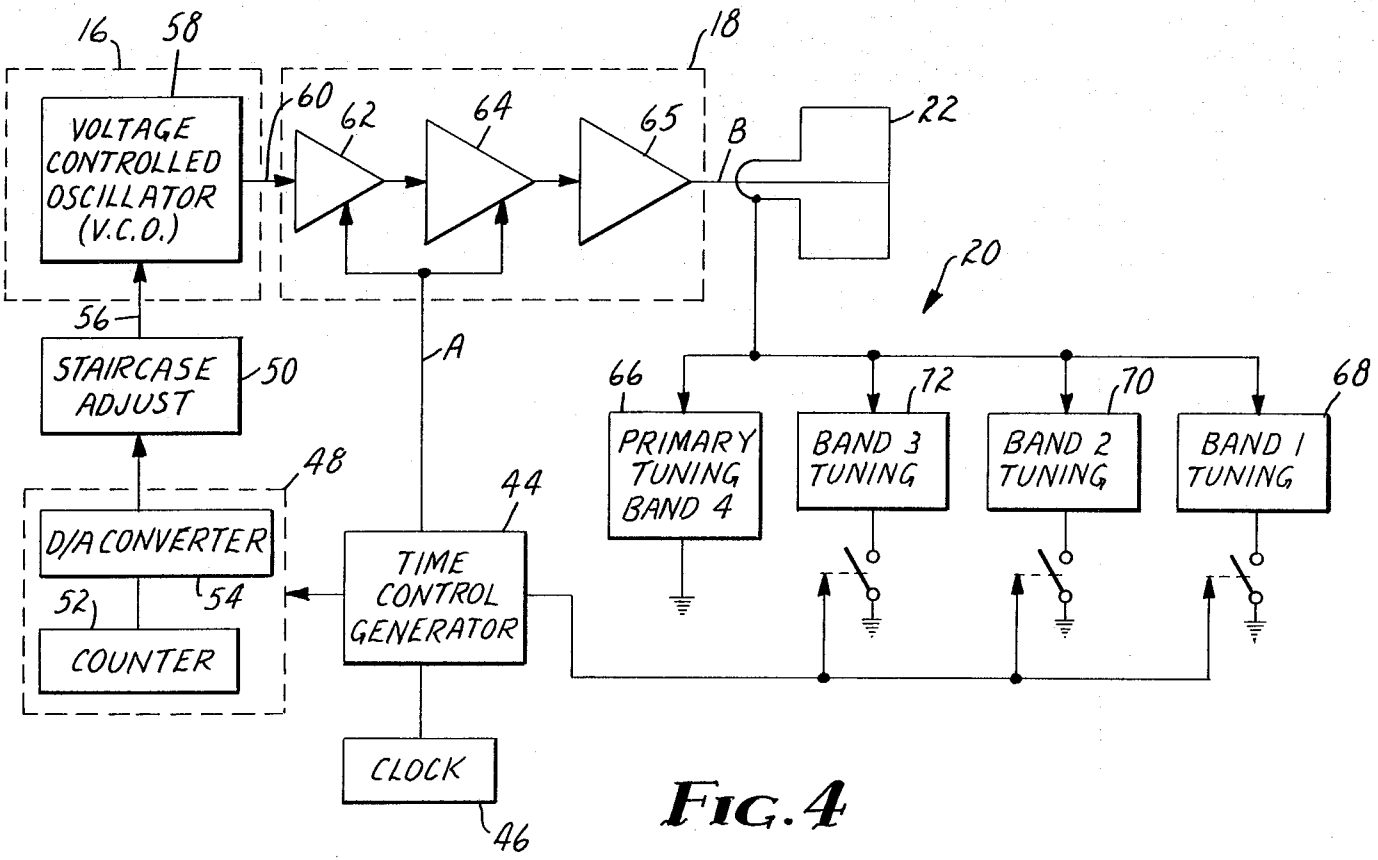
FIG. 4 is a block diagram of the transmitter portion of the system of the present invention.

Additional details of the transmitter 10 of FIG. 1 are set forth in FIG. 4. As is there shown, the staircase generator 48 is formed of a digital counter 52 and a digital to analog (D/A) converter 54. Appropriate pulses from the time control generator 44 are accumulated within the counter 52 until counts corresponding to a time duration of 384 microseconds have been accumulated. This count is then converted via the converter 54 into an analog level having a 384 microsecond duration. Similarly, the counter continues to count for successive 384 microsecond intervals, and supplies a new analog level to the D/A converter 54 during each of such intervals to generate a staircase ramp, each level in the staircase lasting 384 microseconds, there being 64 such levels in the ramp. At the end of such a sequence the counter is reset so as to begin a second identical sequence, each sequence thus lasting 24.576 milliseconds. The produced staircase is shown as Curve L in FIG. 7.

The respective amplitudes of the staircase signal is adjusted in the network 50 and one output therefrom provided on lead 56 to the voltage controlled oscillator network 58. Within the network 58 is a commercial integrated circuit such as type MC 1648 manufactured by Motorola. Such a circuit converts the staircase voltage signal provided via the staircase adjust network 50 into a plurality of discrete frequencies centered about a given frequency, as dictated by a resonant circuit. In a preferred embodiment, such a center frequency may be 4.5 MHz, and the range of discrete frequencies extending between 4.2 and 4.8 MHz. Continuous bursts of each of the discrete frequencies are thus provided on lead 60, to a Class A amplifier 62. Signals outputed from that amplifier are in turn coupled to a driver Class A amplifier 64. Both the amplifiers 62 and 64 are in turn activated by the transmitter enable pulses (Curve A of FIG. 3), thus switching the continuous oscillations at each of the discrete frequencies into the succession of 20 microsecond bursts, each burst being followed by a 28 microsecond quiescent period, thereby forming the staircase of discrete frequencies, as shown in FIG. 2. Such a signal is then coupled to the Class C power amplifier 65 and the output therefrom provided to the transmitter antenna 22.

To minimize the power level necessarily supplied to the transmit antenna 22, the antenna is desirably tuned to match the frequency to be transmitted. In the present system, it has been found preferable to provide such tuning over four separate frequency bands, each band being centered about one-fourth of the range of frequencies encompassed by the output of the VCO 58. Thus as shown in FIG. 4, the antenna tuning network 20 encompasses four tuning stages, a primary tuning stage 66 (band 4) and three secondary turning stage 68, 70 and 72. (bands 1, 2 and 3 respectively) The details of each of these stages are set forth in more detail in FIG. 6 hereinafter, but in FIG. 4 it may be noted that the primary band 66 is continuously coupled to the transmit antenna 22 while the secondary bands 68, 70 and 72 are alternatively coupled to the antenna 22 under the control of appropriate signals from the time control generator 44.

Figure 5:
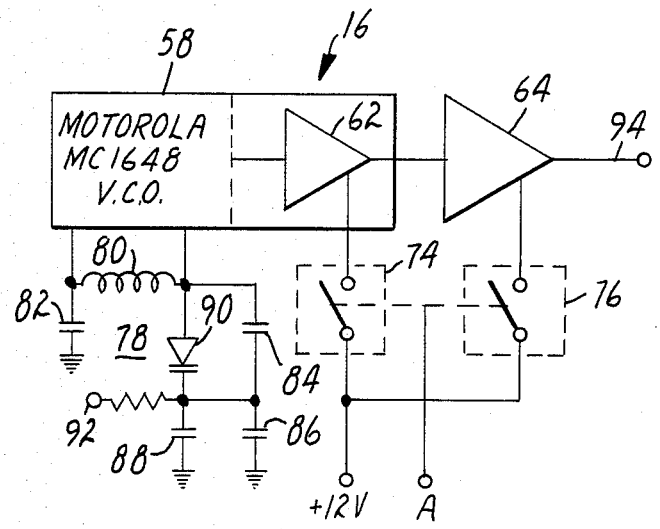
FIG. 5 is a combined schematic and block diagram of the burst frequency generator portion of the transmitter shown in FIG. 4.

Additional details of the VCO network shown in FIGS. 1 and 4 are shown in FIG. 5. As may there be seen, the VCO 58 and first amplifier 62 are both a portion of a single integrated circuit such as a Motorola type MC1648. The amplifiers 62 and 64 are activated by means of solid state switches 74 and 76 respectively under control of the transmit enable pulses (Curve A of FIG. 3) provided from the time control generator 44.

The frequency of the oscillations provided by the VCO 58 is controlled by a resonant inductor/capacitor network 78. This network includes an inductor 80 and capacitors 82, 84, 86 and 88, and varactor diode 90. Of particular importance to the network 78 is the varactor 90, the capacitance of which is an inverse function of the voltage applied thereto. As the resonant frequency of the inductor/capacitor network 78 is an inverse function of the inductance and capacitance of the circuit, the resonant frequency will increase with increasing voltage applied at terminal 92. Accordingly, by the application of a voltage staircase such as Curve L shown in FIG. 7, together with the transmitter enable pulses (Curve A), the VCO network 16 provides the appropriate succession of bursts at the desired discrete different frequencies on output lead 94.

Figure 6:
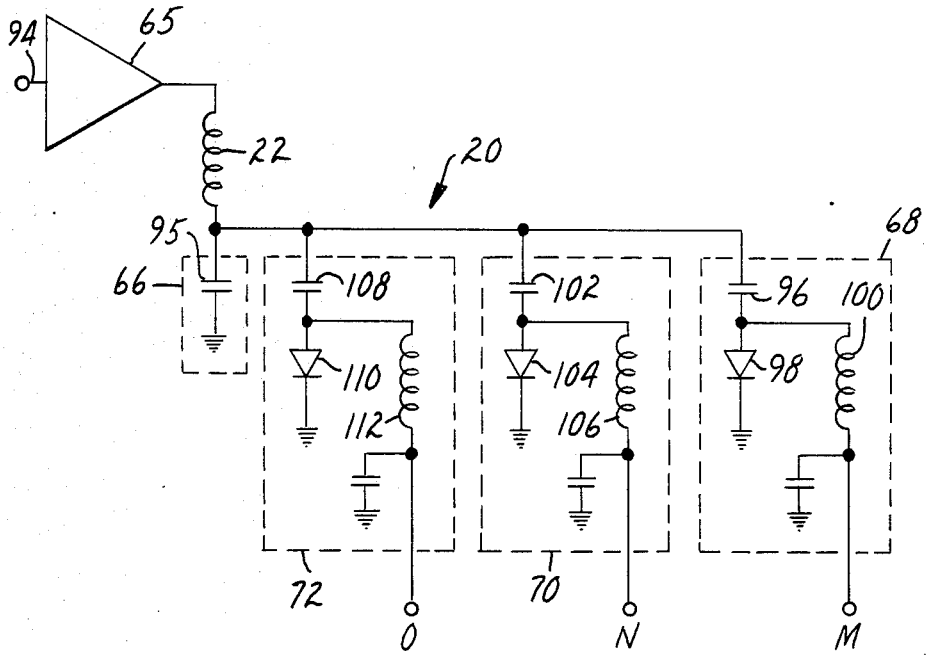
FIG. 6 is a combined schematic and block diagram of the antenna tuner portion of the transmitter shown in FIG. 4.

Similarly, additional details of the antenna tuning network 20 shown in FIGS. 1 and 4 are shown in FIG. 6. As may there be seen, the output signal provided from the VCO network 16 on lead 94 is coupled to the power amplifier 65 and the amplified output therefrom to the transmit antenna 22. As shown in FIG. 6, the antenna is desirably is in the form of an inductive winding, and preferably includes at least one twisted loop such as disclosed in U.S. Pat. No. 4,251,808 (Lichtblau). The antenna 22 forms the inductive component of a resonant circuit, the other component being formed via one of a number of parallel capacitors made up within the tuning stages 66, 68, 70 and 72 respectively. The fundamental tuning of the transmitting antenna is thus provided by the capacitor 95 within the primary tuning stage 66. As the frequency of the tuned circuit is highest when the capacitance is the lowest, it will be recognized that the highest frequency will be provided when only the capacitance within the primary stage 66 is coupled with the antenna 22. Similarly, depending upon which of the stages 68, 70 and 72 are activated and upon the value of the respective capacitors within each stage, it will be recognized that bands of varying frequency are provided. Thus, for example, capacitor 96 within the includes a 64 bit shift register 176, an AND-gate 178, a 4-bit register 180, a triple input AND-gate 182, a one-shot monostable multivibrator 184, and a variable length shift register 186, variable inputs to which are coupled through a switchable resistor network 188. The output of the one shot 184 is in turn coupled via lead 190 to an appropriate alarm device 192 which may be a flashing light, chime or the like.

The 64-bit shift register 176 responds to the sixty-four detector signal-pulses produced during each sequence and stores each of the 64 pulses on a first in first out basis. Upon receipt of the first pulse of a subsequent sequence, the first pulse of the preceding sequence is then outputted on lead 194 to one input of the AND-gate 178. Simultaneously, the first pulse of the second sequence appearing at terminal 174 at the input to the shift register 176 is coupled to the other input 196 of the AND-gate 178. If both detector pulses are high at the same time, AND-gate 178 similarly goes high, and provides a high input pulse to the 4-bit shift register 180. The 64-bit shift register 176 is clocked once every 8 quiescent periods by the comparator sample pulse (Curve J) appearing at terminal 172, thereby outputting one pulse in either a high or low state on lead 194 once for each 8 successive quiescent periods. The 4-bit shift register 180 is similarly clocked by the comparator sample pulse (Curve J) once for every 8 consecutive quiescent periods. Thus in the event three consecutive pulses are passed through the AND-gate 178 in consecutive sequences, three pulses will be provided at the output of the 4 bit shift register 180 appearing on leads 198, 200 and 202 respectively. The occurrence of three high states prior to the time that the 4 bit shift register 180 is reset by the end-of-sweep period pulse (Signal P of FIG. 7) causes the AND-gate 182 to be switched to a high state, thereby providing a prealarm signal on lead 204.

Figure 12:
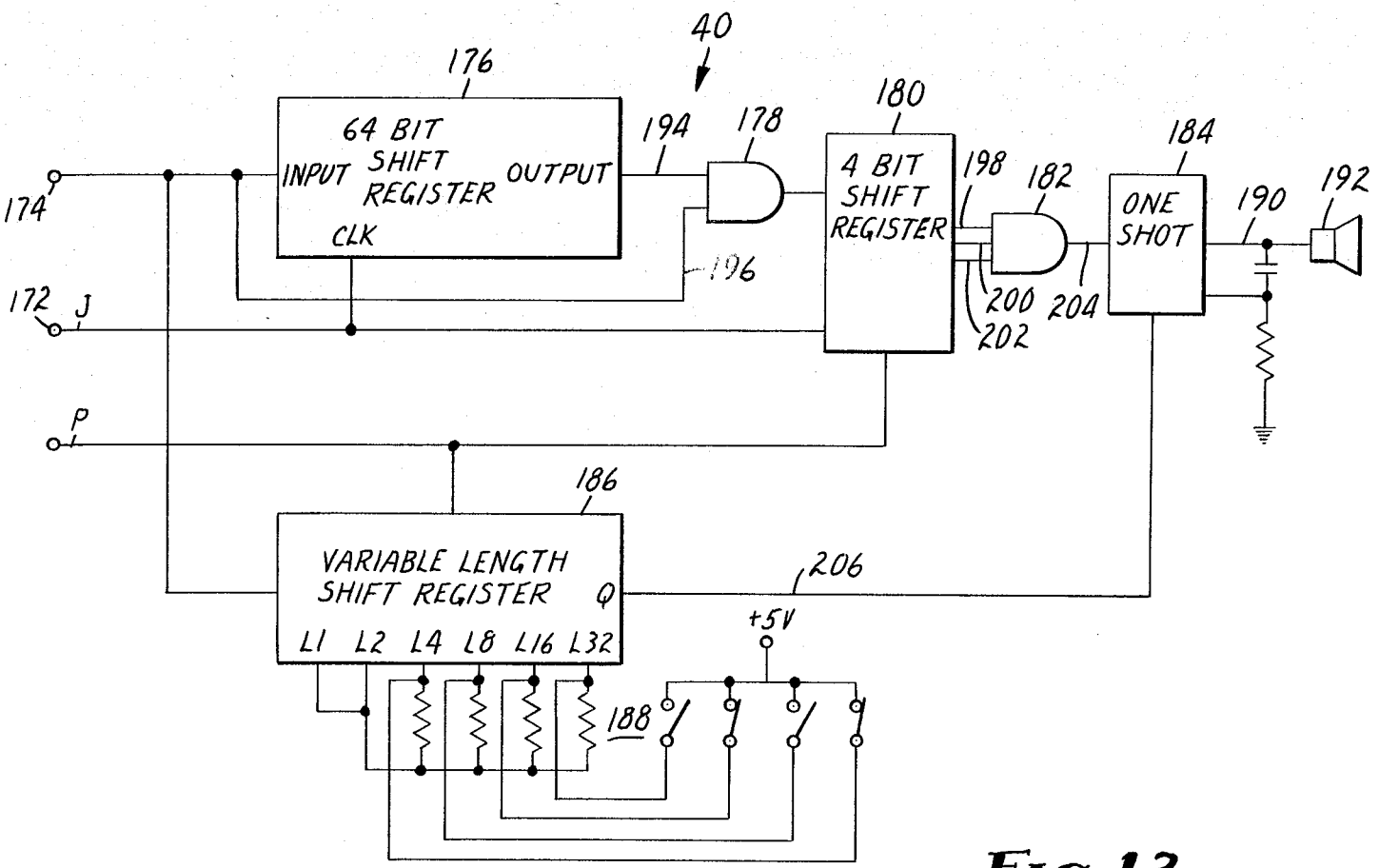
FIG. 12 is a combined schematic and block diagram of the detector shown in the block diagram of FIG. 1.

The prealarm signal may be inhibited from creating an alarm signal on lead 190 by deactivation of the one shot. As shown in FIG. 12, the detector signals on lead 174 are also coupled to the input of the variable length shift register 186, which register is also reset by the end-of-sweep signal (Curve P). Depending upon the position of the respective switches, the shift register 186 will accumulate a given number of detector pulses, and upon that number being exceeded, will pass an alarm inhibit signal on lead 206, which disables the one-shot 184, thereby preventing the production of the alarm signal on lead 190. The purpose of the variable length shift register 186 is thus to provide a maximum count inhibit provision which locks out signals from producing an alarm in the event of the presence within the interrogation zone of a low Q circuit, causing a response to be produced which extends over an excess number of the discrete frequencies within the transmitted staircase. Thus while such responses are required to be produced by a valid marker, and it is further desired to detect the presence of a limited number of valid markers within the interrogation zone at the same time, responses corresponding to more than 10 frequencies within a sequence of 64 frequencies would clearly be outside the desired allowed response, and hence the inhibit signal on lead 206 would be desirably activated.

The overall design strategy of the system of the present invention is predicated on the use of a plurality of resonant circuits within the marker 14 as shown in FIG. 1, wherein all resonant frequencies are known to be within a predetermined tolerance of a designed nominal resonant frequency, but wherein the specific resonant frequency of any one such tag is unknown. Such a design philosphy enables the marker circuits to be inexpensively constructed and not to require individual, and hence expensive, quality control testing. In one embodiment, such a tolerance may be as broad as $\pm 10\%$, while in a preferred embodiment, tolerances in the range of $\pm 7\%$ are readily obtained while not materially affecting production costs. Such a marker circuit may be prepared from discrete bobbin wound coils and capacitors mounted on inexpensive insulative substrates, or may be made by conventional printed circuit techniques utilizing etched, punched metallic foils as the inductive component having a dielectric such as a thin polymeric web, sandwiched therebetween to provide the capacitive component. The Q-factor of such circuits is similarly required to be not less than 50 and preferably in the range of 70 to 100. The Q factor of such circuits have associated therewith a bandwidth according to the expression $Q=f/BW$ where f is the resonant frequency of the circuit and BW is the associated bandwidth. It will thus be appreciated that at a Q-factor of, for example, 70 and a resonant frequency of 4.5 MHz, a bandwidth of approximately 64 kHz will be present. In order for three adjacent transmitted frequencies to be within the bandwidth, such that energy at all three frequencies will be absorbed by the circuit and be reemitted at the resonant frequency of the circuit, requires that at least four discrete frequencies within the 64 kHz span be provided. In the preferred embodiment discussed hereinabove, a predetermined range of frequencies extending over 0.6 MHz are divided into 64 separate increments, each increment thus being 9.4 kHz away from the next adjacent frequency. Approximately seven such frequencies would thus be within the three dB bandwidth, three dB being approximately 0.7 of the maximum voltage signal associated with the response of such a circuit. Alternatively stated, it is required that within the system of the present invention each LC circuit be selected to have a bandwidth (BW) in the range of 20 to 100 kHz.

In order that sufficient energy be absorbed within the interrogation zone at power levels consistent with FCC restrictions, it is desired that the inductive portion of each LC circuit have an area of at least 6 $cm^2$. While smaller area inductive circuits are viable in certain applications, for the system of the present invention to be utilized in retail antipilferage applications, where FCC requirements must be met, such a size restriction is appropriate. It will thus be recognized that each LC circuit utilized in the system of the present invention has a specific resonant frequency within a predetermined frequency range ($\Delta f$) of the nominal resonant frequency and has a Q-factor associated therewith which is also within a given range. Consistent with such specifications on the LC circuits, the transmitter is required to generate a sufficient number of a plurality of different frequencies extending over a range of frequencies at least as wide as the sum of the predetermined range of resonant frequencies of the LC circuits and the maximum bandwidths of such circuits. It may similarly be recognized that in order for a sufficient number of frequencies to be present to suitably energize a plurality of markers having resonant frequencies extending over a predetermined frequency range $\Delta f$, that the number of discrete frequencies may be given by the expression $3(Q_{max} \times \Delta f + f_{min})/f_{min}$, where $Q_{max}$ is the highest Q factor of any of the LC circuits and $f_{min}$ is the minimum resonant frequency of any of the circuits. In a typical first stage 68 is coupled to the primary stage the capacitor upon energization of the PIN diode 98. The energization of the PIN diode 98 is enabled through a feed choke 100 in response to a control pulse (Curve M of FIG. 7) applied thereto. The second stage 70 similarly comprises a capacitor 102 which is selectively coupled to ground through PIN diode 104 which in turn may be placed in its conductive state via a pulse (Curve N in FIG. 7) provided through the choke 106. The capacitor 108 within the third stage 72 may similarly be coupled to ground via PIN diode 110 which in turn is placed in its conductive state by a pulse (Curve O own in FIG. 7) applied through a feed choke 112.

Figure 8:
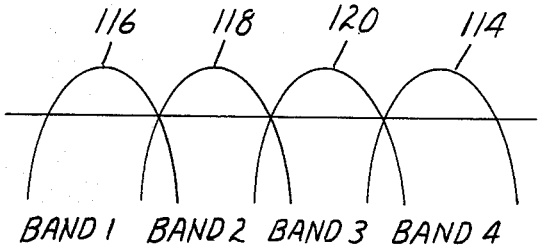
FIG. 8 is a pictorial representation of the frequency bandwidth provided by each of the transmitter antenna tuning stages set forth in FIG. 6.

Each of the frequency bands are desirably designed to encompass a band of frequencies. FIG. 8 pictorially illustrates the desired frequency bands encompassed by each of the circuits. Thus, for example, the primary tuning band 66 corresponds to the highest frequency, shown as Curve 114 in FIG. 8, whereas the frequency resulting upon energization of the first stage 68 is shown as Curve 116, that produced upon energization of the second stage 70 is shown as Curve 118, and that provided upon energization of the third stage 72 is shown as Curve 120.

Figure 7:
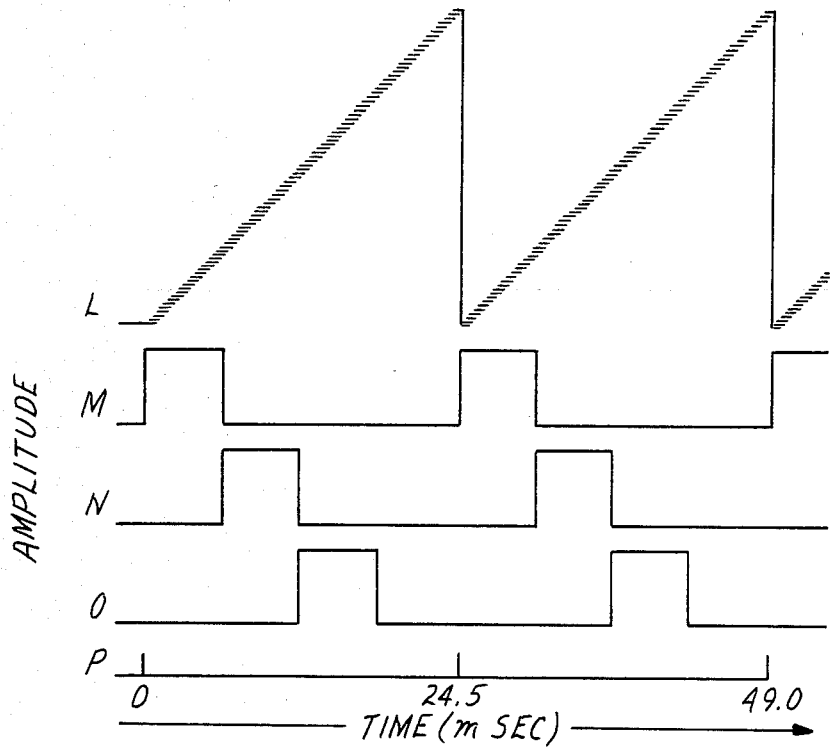
FIG. 7 is a timing diagram showing the staircase ramps supplied for generating discrete frequencies together with switching pulses utilized in switching the transmitter antenna circuit.

Upon the completion of the appropriate interval during which the highest frequencies in the staircase are produced, the end of each successive sequence is triggered via an end-of-sweep signal shown as Curve P of FIG. 7, which signal as provided by the time control generator 44 is coupled to the staircase generator to reinitiate the beginning of the next successive sequence.

Figure 9:
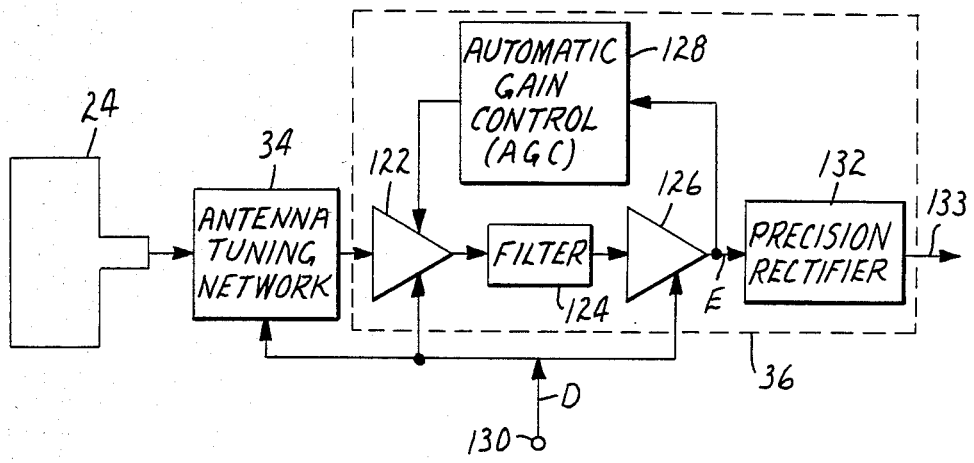
FIG. 9 is a block diagram of the antenna tuning and amplifier section of the receiver shown in FIG. 1.
Figure 10:
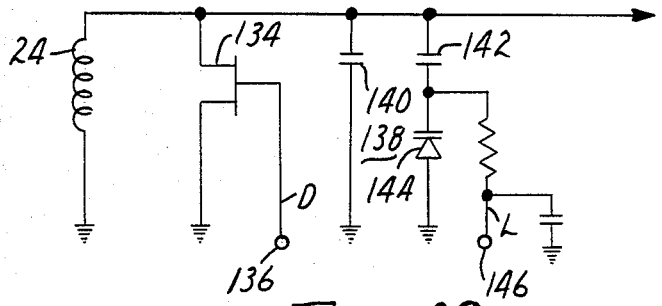
FIG. 10 is a schematic view of the antenna tuning network shown in FIG. 9.

Details of the antenna tuning network 34 and amplifier 36 within the receiver section 12 are provided in FIGS. 9 and 10. Particularly as shown in FIG. 9, electromagnetic signals received via the antenna 24 and coupled through the antenna tuning network 34 are amplified and rectified within the amplifier 36. That amplifier includes a preamplifier 122, a band pass filter 124, an amplifier 126, and an automatic gain control (AGG) network 128. As previously noted in conjunction with FIG. 3, receiver mute pulses (Curve D of FIG. 3) are applied at terminal 130, and are used in an inverted manner to that shown in conjunction with the transmit enable pulses applied to the amplifiers 62 and 64 in FIG. 4 to disable the amplifiers 122 and 126 when the receiver mute pulses are high, thereby enabling signals to pass through those amplifiers only when the receiver mute pulses are in a low state. The amplifiers 122 and 126 are of conventional design to give appropriate gain. Amplified signals passing through the preamplifier 122 are acted upon within band pass filter 124 to remove signals appreciably outside the frequency band of interest, thereby enhancing the signal to noise ratio of signals subsequently passed on for further processing. The automatic gain control network 128 is similarly of conventional design. The output from amplifier 126 (Curve E of FIG. 3) is then passed through a precision rectifier 132 which is biased to provide maximum sensitivity for signal detection.

The details of a preferred embodiment of the receiver antenna tuning network 34 are set forth in FIG. 10. As may there be seen, the receiver antenna 24 includes a simple loop antenna such as may be formed of a single turn coil mounted in close proximity to the transmit antenna 22. To prevent energy from being stored in the receive antenna during the transmit cycles which could otherwise saturate the preamplifier 122, the antenna 24 is shorted during the transmit enable periods i.e., when the receiver mute pulses (Curve D of FIG. 3) are at a high state. This disabling is provided by means of a field effect transistor (FET) 134 which is switched to its conductive state upon receipt of the receiver mute pulses at terminal 136. Tuning of the input stages of the receiver are provided by means of an inductor-capacitor network 138 made up of the inductive antenna 24 and fixed capacitors 140 and 142 together with a varactor diode 144. As the amplitude of the received signals is significantly lower in magnitude than that of the transmitted signals, tuning of the receiver antenna is readily done by applying a voltage staircase, such as Curve L of FIG. 7, at terminal 146 and thence directly to the varactor 144. The resultant change in capacitance over sixty four discrete voltage steps, thus results in a similar tuning of the antenna over the sixty four frequencies as are preferably present in the transmit sequences. The use of the FET 134 in the receiver tuning network 134 is preferred inasmuch as it minimizes loading of the antenna and hence enables a high Q factor to be present.

Figure 11:
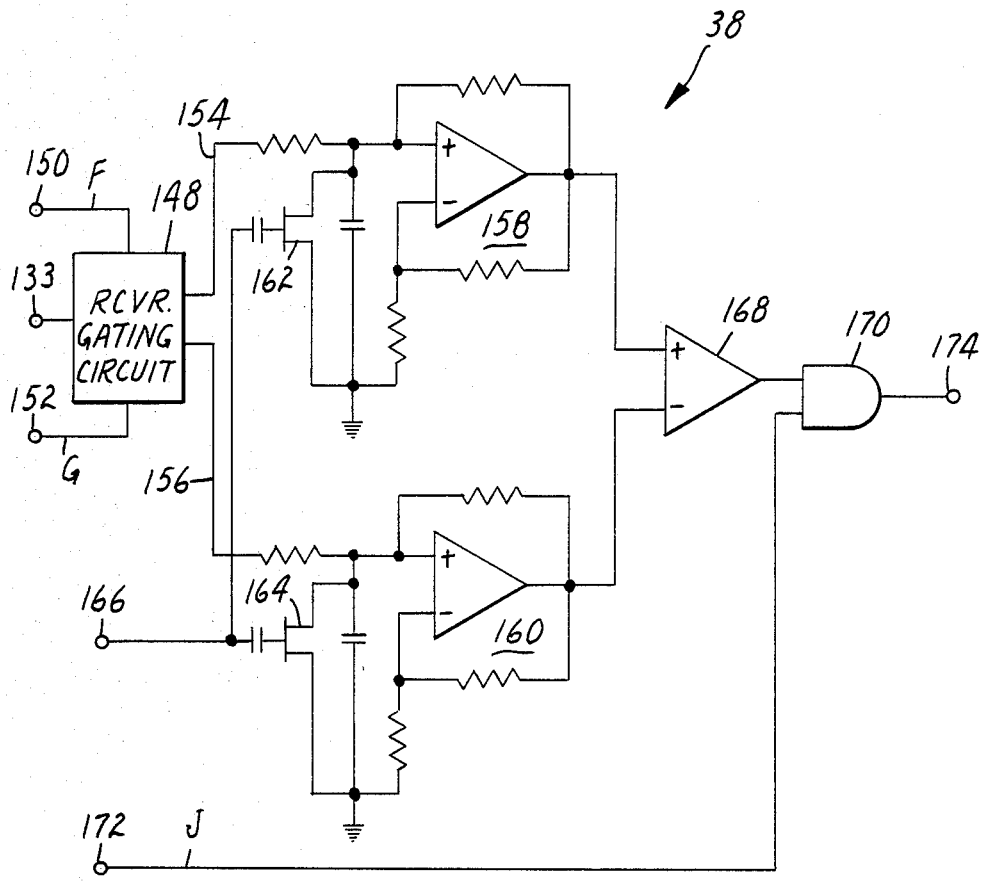
FIG. 11 is a schematic view of the integrator/comparator network shown in FIG. 1.

FIG. 11 shows details of the circuitry provided in the integrator/comparator network 38 of FIG. 1. As may there be seen, the output from the precision rectifier 132 is coupled via lead 133 to a receiver gating circuit 148. This circuit is responsive to the marker window pulses and noise window pulses (Curves F and G of FIG. 3) as applied at terminals 150 and 152 respectively, to appropriately pass the signal receive on lead 133 through the gate onto lead 154 during the time the marker window (Curve F) is present, or alternatively to pass the signal onto lead 156 during the time the noise window pulse (Curve G) is present. The signals on leads 154 and 156 respectively are passed to identical integrator circuits, a marker integrator circuit 158, and a noise integrator circuit 160 respectively. As is conventional, each integrator comprises an RC integrating network, an operational amplifier, and appropriate biasing resistors. Each input is additionally coupled to ground via a FET 162 and 164, respectively, thereby enabling the integrators to be reset when the FET's are in a conductive state. The inputs to the FET's are in turn jointly coupled to terminal 166, to which terminal the integrator reset pulses (Curve K of FIG. 3) are applied. Thus, upon the completion of each of the succession of eight quiescent periods associated with each different frequency, the reset pulse K causes the FET's 162 and 164 to conduct, thereby removing the charge from the integrator capacitors. The output of each of the respective integrators 158 and 160 are coupled to a comparator circuit 168 and the output therefrom coupled to an AND-gate 170. The comparator 168 is a conventional analog comparator and provides a high output pulse in the event the accummulated signal from the marker integrator 158 is greater than that provided by the noise integrator 160 during each eight burst sequences. The relative amplitude as determined by the comparator circuits 168 is then passed through the AND-gate 170 upon the production of the comparator sample pulse (Curve J of FIG. 3) appearing at lead 172. Accordingly, at the appropriate interval, a detector signal is produced at terminal 174 having two possible states, a low state in the event in the accumulated noise signal is greater than that of the accumulated marker signal and a high state in the event the accumulated marker signal is greater than the accumulated noise signal.

FIG. 12 sets forth the details of the detector circuit 40 shown in FIG. 1. As is there shown, the detector 40 case, where for example, $Q_{max}$ is 100, $\Delta f$ is 0.9 MHz and the minimum resonant frequency of any of the tags is 4.05 MHz, it may be recognized that about 70 incremental steps between the minimum and maximum frequencies would be desired. In a preferred embodiment wherein a $\Delta f$ of only 0.6 MHz is expected, and wherein a minimum resonant frequency of approximately 4.2 MHz would occur, approximately 46 incremental steps would be sufficient. As noted above, in a preferred embodiment, 64 such incremental steps is desirably provided.

While the system of the present invention has been described hereinabove in conjunction with a preferred embodiment, it is recognized that various modifications and variations of the present invention may similarly be implemented and be within the scope of the present invention. For example, while the sequence of a plurality of discrete different frequencies may desirably be a repetitive sequence of closely spaced apart frequencies each of which is incrementally higher than the preceding one, it is readily recognized that such a sequence may be considerably altered. For example, such a sequence may be in the form of ascending and descending adjacent sequences. However, repetitive sequences of ascending, incrementally increasing frequencies are desired, inasmuch as the comparisons of potential marker produced signals in adjacent sequences is simplified, as potential marker signals produced at the same frequency will thus occur at the same relative location within each repetitive sequence. It also recognized that with the advent of microprocessor controls, the association of a marker produced signal with a specific frequency becomes much more feasible notwithstanding an irregularity in the time of such pulses within a given sequence. Thus it is well within the scope of the present invention that each sequence may present the plurality of different frequencies in any random order, with each sequence being significantly different in order of frequencies, it only being desired that each sequence contain each of the discrete frequencies. In a still further embodiment, it is anticipated that in some sequences, not all of the discrete different frequencies presented in initial series of sequences be presented. Thus, for example, upon the activation of a preliminary alarm signal such as may be produced by three successive frequencies in two successive sequences, additional sequences may be produced wherein only frequencies of potential interest are reproduced or wherein frequencies outside of the range resulting in the previous alarm signals are produced. Such specific interrogation of a potential marker enhances the reliability of the overall system.

Similarly, it is well recognized that a large variety of specific transmitter antenna tuning configurations may be utilized. In the preferred system disclosed hereinabove, the use of PIN-diodes to tune a limited number of frequency bands has been found desirable due to the intensity of the desired transmitted energy. In various embodiments wherein power requirements may not be as stringent, varactor tuning such as disclosed in conjunction with the receiver antenna tuning may well be suitable.

It is also recognized that variations in the antenna tuning, amplifier, integrator, comparator, and detector portions of the receive may be provided. Thus, for example, while in the integrator of the present invention, accumulated noise signals are desirably compared with accumulated marker signals via analog integrators and comparator circuits, it is within the scope of the present invention that such signal processing may be implemented by zero crossing techniques and by analogous digital signal processing.

It is also well within the scope of the present invention that any number of a plurality of bursts at each frequency may be provided, and that signals produced during a greater number of sequences may be compared.

We claim:

1. An electronic article surveillance system including (a) transmitter means for creating within an interrogation zone, bursts of electromagnetic energy at discretely different radio frequencies within a predetermined range of frequencies, each burst being spatially separated from the next by a quiescent period during which the transmitter means does not transmit, (b) receiver means for receiving electromagnetic signals at said radio frequencies during said quiescent periods and for activating alarm means when said received signals exceed a predetermined level, and (c) marker means adapted to be affixed to an article, the presence of which within said interrogation zone is to be monitored, said marker means comprising an inductive-capacitive (LC) circuit resonant at a frequency within said range of frequencies such that when said marker means is in said interrogation zone RF transmitted energy is absorbed by said circuit and is reemitted at said resonant frequency during the subsequent quiescent period for receipt by the receiver means, wherein in the improvement, said system comprises a plurality of marker means, each adapted to be affixed to an article and each comprising a said LC circuit including an inductive-capacitive-resistive combination designed to have a Q-factor of not less than 50, a nominal resonant frequency f, and an associated bandwidth (BW) centered about said resonant frequency f, all as defined by the expression $Q=f/BW$, said transmitter means comprises means for creating within said interrogation zone bursts of a sufficient number of different RF frequencies, such that there are bursts of at least three different frequencies sufficiently close to the resonant frequency of each of said LC circuits so as to fall within the bandwidth BW thereof, and said receiver means comprises means at least responsive to frequencies extending through the bandwidth BW of all said LC circuits for activating said alarm means when signals exceeding said predetermined level and corresponding to at least three frequencies are detected.

2. A system according to claim 1, wherein each LC circuit comprises a combination of components having a Q-factor in the range of 70–100.

3. A system according to claim 1, wherein each LC circuit is selected to have a bandwidth (BW) in the range of 20–100 KHz.

4. A system according to claim 1, wherein the inductive portion of each LC circuit has an area of at least 6 $cm^2$.

5. A system according to claim 1, wherein each LC circuit is characterized by a specific resonant frequency within a given tolerance of said nominal resonant frequency, and wherein said transmitter means includes means for transmitting bursts of RF energy at different frequencies, the frequencies of which extend beyond the range of resonant frequencies of all of said LC circuits defined by said given tolerance such that at least three RF frequencies are within the bandwidth BW of all of said LC circuits whose resonant frequency is defined by said given tolerance.

6. A system according to claim 5, wherein said given tolerance is within ±10% of said nominal resonant frequency and wherein said transmitter means includes means for generating bursts of at least three different RF frequencies within the bandwidth of all of said LC circuits whose resonant frequencies are defined by said ±10% tolerance.

7. A system according to claim 1, wherein each LC circuit has a specific resonant frequency within a predetermined frequency range (Δf) of said nominal resonant frequency and a Q-factor associated therewith within a given range, and said transmitter means includes means for generating bursts of a plurality of different frequencies extending over a range of frequencies which is at least as wide as the sum of $\Delta f + BW_{max}$, where $BW_{max}$ is the broadest bandwidth of any of said LC circuits.

8. A system according to claim 7, wherein said means for generating bursts of different frequencies extending over said range of frequencies includes means for providing bursts having frequencies which are incrementally different from the next closest frequency, each increment being not more than one-third the narrowest bandwidth $BW_{min}$ of any of said LC circuits.

9. A system according to claim 8, wherein said transmitter means includes means for producing a plurality of bursts of RF energy spaced at equal increments and including at least as many discrete frequencies as determined by the expression $$\frac{3(Q_{max}\,\Delta f + f_{min})}{f_{min}}$$

where $Q_{max}$ is the highest Q-factor of any of said LC circuits, and $f_{min}$ is the minimum resonant frequency of any of said LC circuits.

10. A system according to claim 1, wherein said transmitter means includes means for providing a plurality of bursts at each of said frequencies.

11. A system according to claim 10, wherein said transmitter means includes means for generating said bursts as a sequence of repetitive ramps of discretely different frequencies, each burst at a given frequency being repeated at least twice and each continuing for a predetermined duration and having a predetermined quiescent period therebetween.

12. A system according to claim 1, wherein said receiver means comprises means for responding to received electromagnetic signals centered about a given center frequency and extending over a limited frequency range within the range of transmitted RF frequencies and for maintaining said center frequency at substantially the same frequency as said transmitted RF energy.

13. A system according to claim 12, wherein said means for responding to signals extending over a limited frequency range comprises tuneable antenna means for initially receiving said signals and responsive to a control signal for varying the center response frequency over said range of received frequencies.

14. A system according to claim 13, wherein said tuneable antenna means comprises an inductive-capacitive (LC) tuned circuit.

15. A system according to claim 14, wherein said LC tuned circuit includes a variable capacitor.

16. A system according to claim 15, wherein the variable capacitor comprises a varactor.

17. A system according to claim 1, wherein said receiver means comprises means for deactivating the receiver means during the periods when said bursts of RF energy are being transmitted.

18. A system according to claim 17, wherein said receiver means includes tuneable antenna means and means for preventing the storage of RF energy in said antenna means during said transmit periods.

19. A system according to claim 17, wherein said receiver means includes at least one controllable amplifier stage and means for activating said stage only during said quiescent periods.

20. A system according to claim 1, wherein said transmitter means comprises an inductive transmit antenna and tuneable antenna means having a variable capacitance, the inductive antenna and variable capacitance in combination forming a tuneable resonant circuit having a bandwidth centered about a variable center frequency which is narrower than said predetermined range of frequencies, and wherein said tuneable antenna means further comprises means for controllably varying said capacitance to vary said variable center frequency such that the bandwidth associated with said circuit encompasses the specific RF frequency within said predetermined range of frequencies being transmitted at any given time.

21. A system according to claim 20, wherein said tuneable resonant circuit comprises a plurality of stages each having a limited bandwidth, the number of stages and bandwidths associated with each being sufficient to encompass said predetermined range of frequencies and means for activating at least one of said stages to provide a tuned circuit having a bandwidth encompassing the RF frequency being transmitted at any given time.

22. A system according to claim 21, where said means for controllably varying the capacitance includes at lest one PIN-diode which when in a conductive state couples an additional capacitor into a selected stage.

23. A system according to claim 21, wherein said tuneable antenna means comprises an inductive transmit antenna and capacitor combination forming said tuneable resonant circuit, and wherein at least some of said stages include means for controllably varying the capacitance thereof.

24. A system according to claim 1, wherein said transmitter means comprises oscillator means for generating said sufficient number of different RF frequencies and control means for activating said oscillator means to output a given frequency at a given time.

25. A system according to claim 24, wherein oscillator means comprises a combination of a voltage controlled oscillator (VCO) and varactor having coupled thereto a step voltage such that the frequency provided at the output of the VCO is stepped through said predetermined range of frequencies.

26. A system according to claim 1, wherein said receiver means comprises means activated during a first interval of time occurring relatively early in each of said quiescent periods when a signal produced by a resonating marker circuit would likely be present for providing a marker signal in response to electromagnetic signals received during said first interval, means activated during a second interval of time occurring relatively late in each of said quiescent periods when no signals produced by resonating marker circuits would likely be present and which would represent ambient background noise for providing a noise signal in response to electromagnetic signals received during said second interval, means for comparing said marker signal and said noise signal and for providing a detector signal in the event said marker signal exceeds said noise signal by a predetermined amount.

27. A system according to claim 26, wherein said comparing means further comprises means for comparing said marker signal and said noise signal produced following each burst of said different radio frequencies.

28. A system according to claim 26, wherein said means for providing said marker signal and means for providing said noise signal each include for means for accumulating said marker and noise signals produced during a predetermined number of successive quiescent periods.

29. A system according to claim 28, wherein said transmitter means includes means for providing a plurality of bursts at each of said different radio frequencies and wherein said means for accumulating said marker and noise signals include means for accumulating said signals occurring following said plurality of bursts at each of said different frequencies.

30. A system according to claim 28, wherein each of said accumulating means includes separate integrator circuits resettable for accumulation of signals in quiescent periods following each of said different frequencies.

31. A system according to claim 30, each of said separate integrator circuits include an output providing an analog integrated signal and wherein said comparator means includes analog means coupled to the outputs of said separate integrator circuits for providing said detector signal when said integrated marker signal exceeds said integrated noise signal.

32. A system according to claim 31, wherein said comparator means includes means for providing an output pulse as said detector signal.

33. A system according to claim 26, wherein said transmitter means includes means for generating said bursts as repetitive sequences of ramps of discretely different frequencies, each burst at a given frequency being repeated at least twice, and wherein said receiver means further includes detector means for determining the presence of a said detector signal during at least two successive sequences.

34. A system according to claim 33, wherein said detector means includes means for storing detector signals produced during a first sequence and for providing a prealarm signal when said stored detector signals correspond with detector signals produced in a subsequent sequence.

35. A system according to claim 34, wherein said storage means includes means for identifying a detector signal produced at each of said discrete frequencies within each sequence and means for producing a said prealarm signal in the event detector signals corresponding to marker signals provided following bursts of at least three different frequencies are detected in consecutive sequences.

36. A system according to claim 35, wherein said detector means further includes means responsive to said detector signals for determining the number thereof occurring during each sequence and hence associated with that number of different discrete frequencies and means for preventing said prealarm signal from activating a said alarm signal in the event said number of detector signals in each sequence is not less than a predetermined number, so as to prevent the occurrence of false alarms due to the presence of a low Q-factor circuit within the interrogation zone having a resonant frequency within the range of said discrete frequencies but also having a bandwidth sufficiently wide to respond to more than said three different frequencies.

37. An electronic article surveillance system including (a) transmitter means for creating within an interrogation zone, bursts of electromagnetic energy at discretely different radio frequencies within a predetermined range of frequencies, each burst being separated from the next by a quiescent period during which the transmitter means does not transmit, (b) receiver means for receiving electromagnetic signals at said radio frequencies during said quiescent periods and for activating alarm means when said received signals exceed a predetermined level, and (c) marker means adapted to be affixed to an article, the presence of which within said interrogation zone is to be monitored, said marker means comprising an inductive-capacitive (LC) circuit resonant at a frequency within said range of frequencies such that when said marker means is in said interrogation zone RF transmitted energy is absorbed by said circuit and is reemitted at said resonant frequency during the subsequent quiescent period for receipt by the receiver means, wherein in the improvement, said transmitter means comprises means for providing a plurality of bursts at each of said different radio frequencies, and wherein said receiver means comprises means activated during a first interval of time occurring relatively early in each of said quiescent periods when a signal produced by a resonating marker circuit would likely be present for providing a marker signal in response to electromagnetic signals received during said first interval, means activated during a second interval of time occurring relatively late in each of said quiescent periods when no signals produced by resonating marker circuits would likely be present and which would represent ambient background noise for providing a noise signal in response to electromagnetic signals received during said second interval, and means for comparing said marker signal and said noise signal produced following each burst of each of said different radio frequencies and for providing a detector signal in the event the net marker signal corresponding to at least two different frequencies exceeds a corresponding net noise signal by a predetermined amount.

38. A system according to claim 37, wherein said means for providing said marker signal and means for providing said noise signal each include means for accumulating said respective marker and noise signals produced during each successive quiescent period following bursts at the same frequency.

39. A system according to claim 38, wherein each of said accumulating means includes a resettable integrator circuit for accumulation of signals in quiescent periods following each of said different frequencies.

40. A system according to claim 39, each of said integrator circuits including an output providing an analog integrated signal and wherein said comparator means includes analog means coupled to the outputs of said integrator circuits for providing said detector signal when said integrated marker signal exceeds said integrated noise signal.

41. An electronic article surveillance system including (a) transmitter means for creating within an interrogation zone, bursts of electromagnetic energy at discretely different radio frequencies within a predetermined range of frequencies, each burst being separated from the next by a quiescent period during which the transmitter means does not transmit, (b) receiver means for receiving electromagnetic signals at said radio frequencies during said quiescent periods and for activating alarm means when said received signals exceed a predetermined level, and (c) marker means adapted to be affixed to an article, the presence of which within said interrogation zone is to be monitored, said marker means comprising an inductive-capacitive (LC) circuit resonant at a frequency within said range of frequencies such that when said marker means is in said interrogation zone RF transmitted energy is absorbed by said circuit and is reemitted at said resonant frequency during the subsequent quiescent period for receipt by the receiver means, wherein in the improvement, said transmitter means includes means for generating said bursts as repetitive sequences of discretely different frequencies, each burst at a given frequency being repeated at least twice, and wherein said receiver means further includes detector means for activating said alarm means upon the detection of received signals exceeding said predetermined level corresponding to at least two transmitted frequencies during at least two successive sequences.

42. A system according to claim 41, wherein said detector means includes means for storing signals received during a first sequence and for providing a prealarm signal when said stored signals correspond with signals received during a subsequent sequence.

43. A system according to claim 42, wherein said storage means includes means for identifying a received signal produced at each of said discrete frequencies within each sequence and means for producing a said prealarm signal in the event received signals corresponding to marker signals produced following bursts of at least three different frequencies are detected in consecutive sequences.

44. A system according to claim 43, further comprising detector means responsive to received signals occurring during each sequence and associated with a number of different discrete frequencies and means for preventing said prealarm signal from activating a said alarm signal in the event said number of detector signals in each sequence is not less than a predetermined number, so as to prevent the occurrence of false alarms due to the presence of a low Q-factor circuit within the interrogation zone having a resonant frequency within the range of said discrete frequencies but also having a bandwidth sufficiently wide to respond to more than said three different frequencies.

* * * * *